United States Patent [19]

Regelin

[11] 4,146,213

[45] Mar. 27, 1979

[54] HOT BLAST OR HOT GAS VALVE

[75] Inventor: Donald H. Regelin, Pittsburgh, Pa.

[73] Assignee: Zimmermann & Jansen, Duren, Fed. Rep. of Germany

[21] Appl. No.: 819,717

[22] Filed: Jul. 28, 1977

[30] Foreign Application Priority Data

Jan. 24, 1977 [DE] Fed. Rep. of Germany ... 7701855[U]

[51] Int. Cl.[2] ..... C21B 7/00

[52] U.S. Cl. ..... 266/197

[58] Field of Search ..... 110/180, 181; 137/340; 266/139, 174, 190, 192, 287, 197, 199

[56] References Cited

U.S. PATENT DOCUMENTS

| | | | |
|---|---|---|---|
| 1,013,961 | 1/1912 | Shutts et al. | 266/139 |
| 2,204,724 | 6/1940 | Cope | 29/156.7 A |
| 2,575,875 | 11/1951 | Johnson | 137/340 |
| 3,068,888 | 12/1962 | Mohr | 137/340 |
| 3,487,849 | 1/1970 | Vietorisz | 137/340 |

*Primary Examiner*—Gerald A. Dost

*Attorney, Agent, or Firm*—Fulwider, Patton, Rieber, Lee & Utecht

[57] ABSTRACT

Summarizing, the present invention provides a hot blast or hot gas valve, particularly for a blast furnace, comprising a liquid or water cooled valve disc adapted to be moved axially for adjustment, wherein said valve disc is formed to be arched unilaterally towards the side of said valve to be shut off, said valve disc including around the sealing edge thereof a hollow section through which coolant flows, and the concave side of said valve disc opposite from the closure side of said valve being covered by a layer or lining of a refractory material, particularly by a ceramic brickwork, within the area enclosed, for instance, by said water cooled hollow section.

2 Claims, 5 Drawing Figures

HOT BLAST OR HOT GAS VALVE

SUMMARY OF THE INVENTION

The present invention relates to a hot blast or hot gas valve, particularly for a blast furnace, comprising a liquid or water cooled valve disc adapted to be moved axially for adjustment, as well as coolant supply means and coolant discharge means, and including a valve operating device at the side of the valve to be closed by the latter.

In conventional valves of this type (U.S. Pat. Nos. 3,439,910 and 2,204,724), the full interior space of the valve disc is formed as a non-partitioned coolant space or chamber, and the exterior shape of the valve disc is of lenticular configuration, i.e. convex on both sides thereof. In such construction, the outer narrow edges of the valve disc in the closed position thereof seat on water cooled gasket rings of the valve seat.

However, tension or stress cracks and weld failures caused by temperature shocks frequently occur in a valve disc of the above construction. Furthermore, it should be borne in mind in this structure that the outer or peripheral narrow edges of the valve disc are necessarily cooled to lesser degree as compared to the center portion thereof, and it is this former portion which is subjected to particularly high thermal stresses, particularly when the hot gases flow around this narrow edges. Additionally, conventional valves of this type require a construction of the valve seat comprised of water cooled hollow sections and having corresponding, special coolant connections.

Accordingly, it is the object of the present invention to provide in a structurally simple and operationally safe manner an improved thermal insulation for the valve disc of a valve of the above-outlined type, which insulation, more particularly, is disposed on the side of the valve subjected to heat from below in the case of valve discs arranged in horizontal position.

The solution of this object, in accordance with the present invention, comprises the combination of features wherein said valve disc is formed to be arched unilaterally towards the side of said valve to be shut off, said valve disc including around the sealing edge thereof a hollow section through which coolant flows, and the concave side of said valve disc opposite from the closure side of said valve being covered by a layer or lining or a refractory material, particularly by a ceramic brickwork, within the area enclosed, for instance, by said water cooled hollow section.

A particularly advantageous feature resides in the fact that said hollow section through which coolant flows is extended over said valve disc body at the concave side of said valve which is covered by said refractory material, so as to laterally enclose or embrace said refractory material layer across at least a part of the thickness of said layer or lining.

Furthermore, in accordance with the present invention the hollow section through which the coolant flows, may be arranged in an approximately normal position with respect to the wall of the valve disc and also around the outer (peripheral) edge of the valve disc.

Another advantageous embodiment may be seen in the fact that said valve disc body is subdivided into separate, spirally extending coolant passages through which the coolant flows, optionally in forced-flow relation with the coolant flowing through said hollow section of said sealing edge.

According to the present invention, it is also contemplated that the coolant supply means may be connected to a point of said hollow section of said sealing edge, and the coolant discharge means may be positioned in the center of said valve disc body.

A particular combination of cooling effect and space or shape structure is obtained in accordance with the present invention if said coolant passages provided within said valve disc body are of smaller axial cross-sectional dimensions than the coolant passages defined within said hollow section of said sealing edge.

The present invention not only provides for application of a refractory brickwork or lining to that side of the valve body which is subjected to major part of thermal stresses, but also ensures constructionally that this lining may be attached so as to be durable or resistant in operation without falling off after some period of time. This is facilitated, on the one hand, by the unilaterally arched, concave configuration of the valve body, and on the other hand, by the marginal or peripheral mounting of the hollow section of the sealing edge passed through by the coolant, which section not only protects the refractory layer or lining against mechanical stress in opening and closing of the valve, but at the same time also provides a support for an arched construction of the refractory lining.

In addition, the hollow section of the sealing edge through which the coolant flows, in contrast with the conventional water cooled valve bodies, provides for a preferable and by means of rate of flow of the coolant and/or cross-sectional configuration - forced-flow cooling of the sealing edge portion of the valve body, such that the disadvantages referred to above are avoided. Besides, an important advantage of the present invention resides in the fact that in the valve disc structure according to the invention special or separate coolant-bearing hollow sections in the valve seat may be omitted, such that the necessary separate coolant connections and conduits may be omitted as well.

The space or shape effect of the coolant passages according to the invention interiorly of the valve disc further increases the stability of the latter without resulting in an unnecessarily heavy-weight construction.

In the following, the present invention is explained in greater detail in connection with embodiments thereof. In the drawings.

Figure 1:
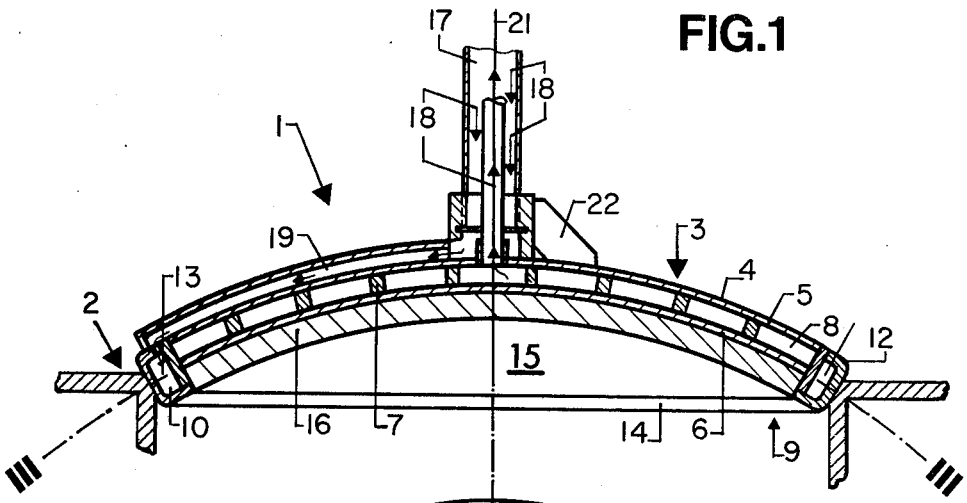
FIGS. 1 and 2 show a longitudinal sectional view and a plan view, respectively, of an embodiment of the valve disc according to the invention.
Figure 2:
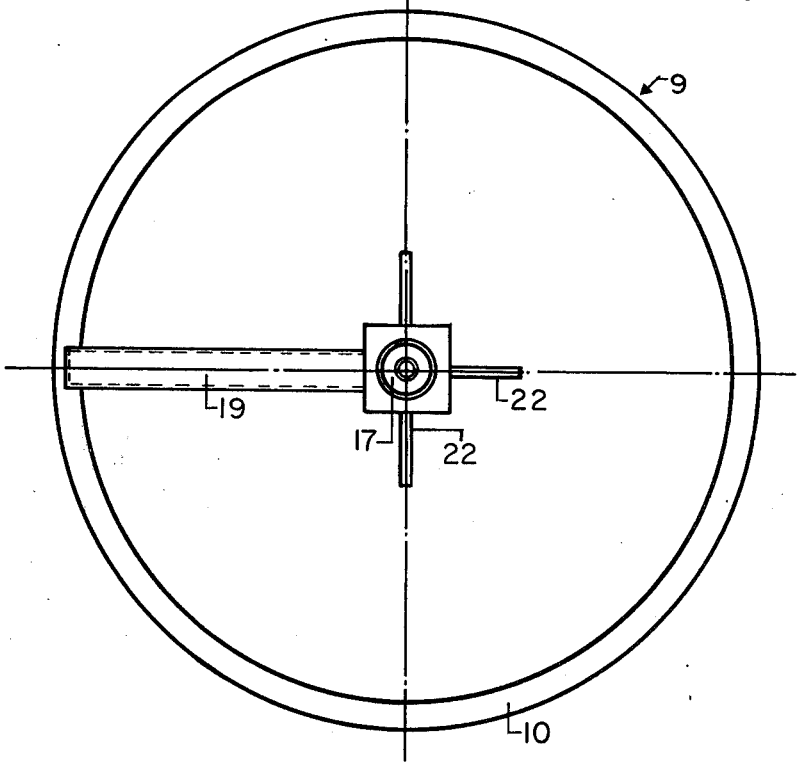
Figure 3:
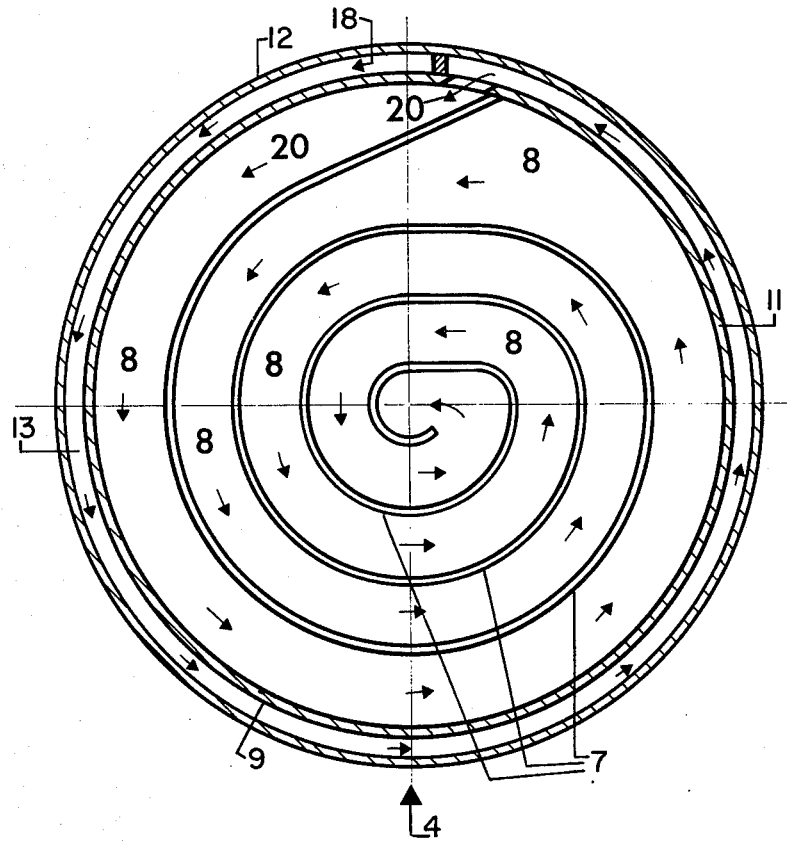
FIG. 3 is a section along the curved plane of section III—III of FIG. 1.

As shown in FIGS. 1 and 2, the valve 1 comprising a valve seat 2 and a valve disc 3 includes a valve disc body 4 formed as a double-wall structure composed of an outer wall 5 and an inner wall 6. Both walls 5 and 6 are spaced from each other by means of partitions 7 placed within the interior spaced between such walls (compare also FIG. 3). As shown in FIG. 3, these partitions 7 are mounted within the valve disc body 4 so as to extend from the center of the latter radially outwards in spiral fashion, thereby to define correspondingly spirally extending coolant passages 8 between walls 5 and 6.

Owing to its sandwich-type configuration, this construction of the valve disc body not only is very stable and of low sensitivity to thermal stresses; rather, this construction is of low specific weight, too. These strength characteristics are still further augmented specifically by the concave, mushroom-like arched or domed configuration of the valve disc body 4.

The outer (peripheral) edge of the double-wall valve disc body 4 is formed by a hollow section 10 which may be constructed by welding together separate section portions, e.g. a wall 11 and a U-shaped or channel section 12, and the interior 13 of which defines a coolant passage for e.g. water. While coolant passages 8 are of relatively low height, i.e. formed with a small axial cross-sectional dimension, the coolant passage defined in the interior 13 of the hollow section preferably exhibits a different cross-sectional configuration, namely a cross-section disposed approximately normal with respect to the line of section III—III; with such cross-sectional configuration, the hollow section 10 forming the sealing edge of the valve disc 3 constitutes the contact surface 14 with the valve seat 2 which as such need not be provided with additional water cooling means.

Owing to this disposition of the hollow section 10 of the sealing edge extending transversely of the plane of section III—III, such hollow section protrudes beyond the inner wall 6 into the concave side 15 of the valve disc body 4 thereby to form with the latter an outer peripheral boundary for a layer or lining 16 of refractory material applied to said concave side 15, which lining, for instance in the form of a refractory ceramic brickwork, covers the entire surface area of the concave side of the valve disc body 4 as enclosed by the hollow section 10, whereas the opposite side of the valve disc body, namely the side of the valve to be shut off, does not require any protection by refractory material because the thermal stresses on this side are substantially smaller than on the concave side 15.

The hollow section 10, particularly because of the unique arrangement thereof, provides both for operational contact with the valve seat 2 and for support of the arched refractory lining.

As shown in FIGS. 1 and 2, cooling water is supplied through a central conduit 17 which, at the same time, functions as the actuating or operating element of the valve disc 3 and which is of double-wall construction. As indicated by arrows 18 coolant is supplied through the central conduit 17 via a connecting pipe 19 initially into the hollow section 10 and from the latter, as indicated by arrow 20, through the coolant passages 8 of the valve disc body 4, with the coolant being discharged from the center point of said body 4 through the inner portion of the double-wall conduit 17 as shown by arrows 21. Conduit 17 is attached to the outer wall 5 of the valve disc body 4 by means of a supporting structure 22. Irrespective of the illustrated flow of coolant, the hollow section 10 and the coolant passages may be connected also to separate coolant connections so as to be cooled in parallel with each other and not in tandem or in series. In view of the higher thermal load, the cross-section of the hollow section 10 preferably should provide for a higher rate of flow of the coolant, while the coolant passages 8 may provide for a lower rate of flow of the coolant because of the layer or lining 16. In the case of a series connected cooling arrangement, the cross-sectional areas of the hollow section 10 and of the coolant passages should be selected with correspondingly different dimensions.

Figure 4:
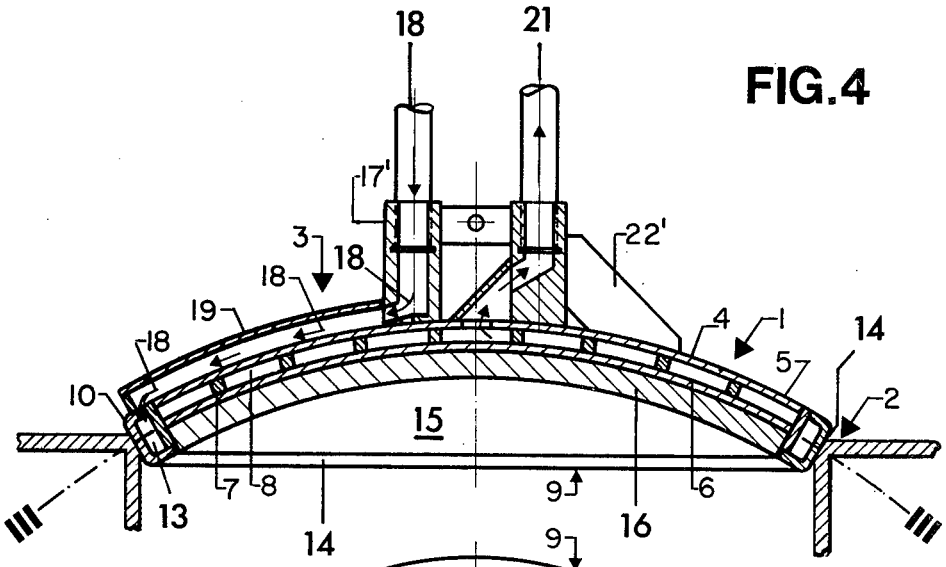
FIGS. 4 and 5 show a longitudinal section view and a plan view, respectively, of a modified embodiment of the valve disc according to the invention.
Figure 5:
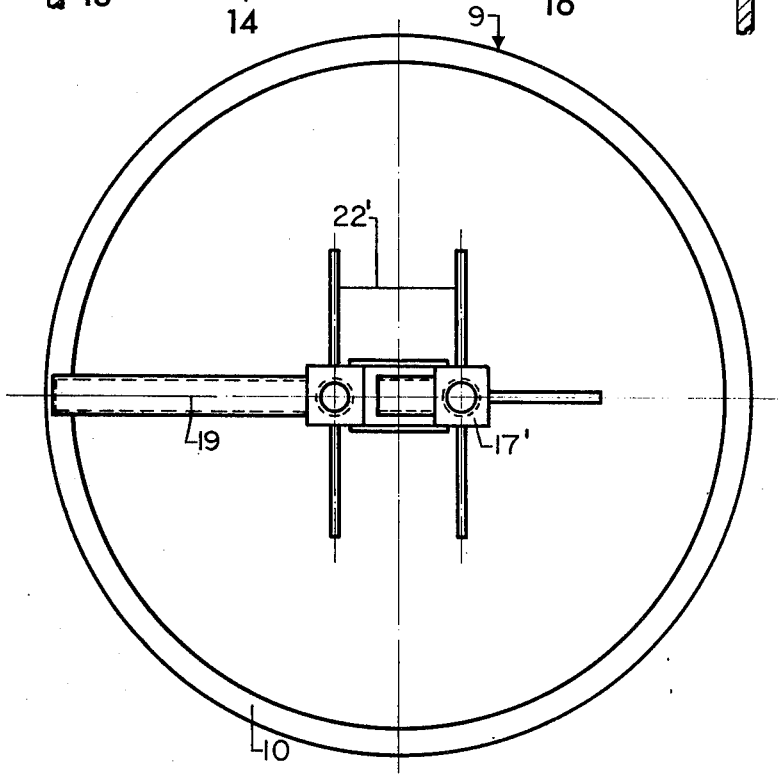

In the embodiment shown in FIGS. 4 and 5, a coolant connection composed of a pair of separate pipes 17', 17' is provided in combination with a correspondingly modified supporting structure 22'.

The present invention is contemplated to embrace every potential combination of the features disclosed.

What I claim is:

1. A hot blast or hot gas valve, for a blast furnace, comprising a liquid cooled valve disc adapted to be moved axially for adjustment, the improvement comprising that said valve disc (3) includes a body arched unilaterally towards the side of said valve (1) to be shut off, and is formed with a spirally extending cooling passage leading from a first inlet formed in the outer periphery thereof to a first outlet formed centrally therein, said valve disc including around the sealing edge thereof, a circular hollow section (10) forming a coolant passage having a second inlet and a second outlet, an inlet passage leading from the center of said disc to said second inlet, said second outlet being registered with said first inlet, and the concave side (15) of said valve disc (3) opposite from the closure side of said valve being covered by a lining (16) of a refractory material, within the area enclosed; for instance, by said water cooled hollow section (10).

2. The valve according to claim 1 wherein said coolant passages (8) provided within said valve disc body (4) are of smaller axial cross-sectional dimensions than the coolant passages defined within said hollow section (10) of said sealing edge.

* * * * *